US010538293B2

(12) United States Patent
Bartelsmeyer et al.

(10) Patent No.: US 10,538,293 B2
(45) Date of Patent: Jan. 21, 2020

(54) SEAT ENCLOSURE

(71) Applicant: Dowco, Inc., Manitowoc, WI (US)

(72) Inventors: Robert Bartelsmeyer, Lebanon, MO (US); Chance Davis, Marshfield, MO (US); Michael Byrd, Springfield, MO (US); Jon Alexander, Kewaskum, WI (US)

(73) Assignee: Dowco, Inc., Manitowoc, WI (US)

( * ) Notice: Subject to any disclaimer, the term of this patent is extended or adjusted under 35 U.S.C. 154(b) by 0 days.

(21) Appl. No.: 16/250,068

(22) Filed: Jan. 17, 2019

(65) Prior Publication Data

US 2019/0233061 A1 Aug. 1, 2019

Related U.S. Application Data

(60) Provisional application No. 62/624,322, filed on Jan. 31, 2018.

(51) Int. Cl.

| | |
|---|---|
| ***B63B 29/04*** | (2006.01) |
| ***B63B 17/00*** | (2006.01) |
| ***B63B 13/02*** | (2006.01) |
| ***B63B 35/34*** | (2006.01) |
| ***B63B 17/02*** | (2006.01) |

(52) U.S. Cl.

CPC ..... *B63B 29/04* (2013.01); *B63B 13/02* (2013.01); *B63B 17/02* (2013.01); *B63B 35/34* (2013.01); *B63B 2029/043* (2013.01); *B63B 2231/40* (2013.01)

(58) Field of Classification Search

CPC ..... B63B 17/00; B63B 17/04; B63B 19/00; B63B 19/12; B63B 3/00; B63B 3/18; B63B 29/00; B63B 29/02; B63B 29/04; B63B 35/34; B63B 13/00; B63B 13/02

USPC ..... 114/363, 364

See application file for complete search history.

(56) References Cited

U.S. PATENT DOCUMENTS

| | | | | |
|---|---|---|---|---|
| 6,443,088 | B1 * | 9/2002 | Putman | B63B 17/04 114/364 |
| 7,000,557 | B1 * | 2/2006 | Forbes | B63B 19/12 114/363 |
| 7,913,637 | B2 * | 3/2011 | Roehm, II | B63B 29/04 114/363 |
| 8,844,460 | B2 * | 9/2014 | Cooney | B63B 1/12 114/364 |

OTHER PUBLICATIONS https://www.youtube.com/watch?v=EBPhUFPQyS4; captured Sep. 14, 2017; YouTube screen capture of 2018 Sylvan M5 LZ DC.

https://www.harrisboats.com/crowne/; captured Nov. 8, 2016; screen shot of Crowne Series Pontoon Boats.

http://www.benningtonmarine.com:80/construction/; captured Feb. 26, 2016; screen shot of Bennington Pontoon Boats.

http://www.benningtonmarine.com/; captured Mar. 13, 2016; screen shot of Pontoon Boats by Bennington.

(Continued)

*Primary Examiner* — Lars A Olson

(74) *Attorney, Agent, or Firm* — Shane Delsman; Godfrey & Kahn, S.C.

(57) ABSTRACT

A seat enclosure includes a number of seats located at the perimeter of a vehicle to form a barrier. The seat includes a base with a panel attached to the backside of the base to give the seat enclosure a finished appearance.

29 Claims, 19 Drawing Sheets

(56) References Cited

OTHER PUBLICATIONS http://www.manitoupontoonboats.com:80/boats/legacy-lt; captured Aug. 1, 2016; Legacy LT Overview, Manitou Pontoon Boats.
https://www.youtube.com/watch?v=kanacQovuzU; Mar. 7, 2016; Side-Winder Pontoon Roll Cover Demonstration.

* cited by examiner

SEAT ENCLOSURE

PRIORITY CLAIM

This application is based on and claims priority to U.S. Provisional Patent Application Ser. No. 62/624,322 filed on Jan. 31, 2018, which is incorporated herein by reference for all purposes.

CROSS REFERENCE TO RELATED APPLICATION

This application claims the benefit of U.S. Provisional Patent Application Ser. No. 62/624,322 filed on Jan. 31, 2018, the disclosure of which is hereby incorporated by reference herein in its entirety for all purposes.

FIELD OF THE INVENTION

The present invention relates generally to the field of seating and/or exteriors for vehicles.

BACKGROUND

Vehicles, for example marine vehicles, are typically built with a perimeter barrier. The purpose of the barrier is to keep people and loose objects from falling off the deck of the marine vehicle and keep the occupants of the vehicle safe. Pontoon boats, for example, are built with a fence or rail that goes around the deck of the boat. Such fences have traditionally been constructed of metal, such as aluminum tubing, clad with thin metal facades, e.g. aluminum. The construction of such a fence is expensive and time consuming. The combination of the different model of boats, the selected layout of furniture and other accessories on the deck and the desired location of entry points, e.g. gates, means that the fence often has to be custom built. The tubes must be cut to length, bent, and welded together and finished for a desirable appearance. The facade must also be installed and secured.

The pontoon boats have evolved from essentially a flat deck with bench seats or lawn chairs to upholstered seats and/or couches with plastic bases. The couches and/or seats are often placed around the exterior of the deck to preserve as much open deck space as possible for use such as entertaining, fishing, moving about, etc. Through such placement, the back of the seats provide a barrier around much of the boat.

More recently, some boat manufacturers have either replaced the aluminum fence with a decorative fiberglass fence or integrally formed fiberglass seats with a decorative back that serves as the barrier. Although the fiberglass panels provide a much more luxury look and are desirable, they are more expensive and require more time to manufacture than the aluminum tube fence that they replace. Fiberglass also requires extensive work to repair, such as if a dock cracks the fiberglass panel.

As such, there is a need for a more cost effective alternate seat enclosure to a fence.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
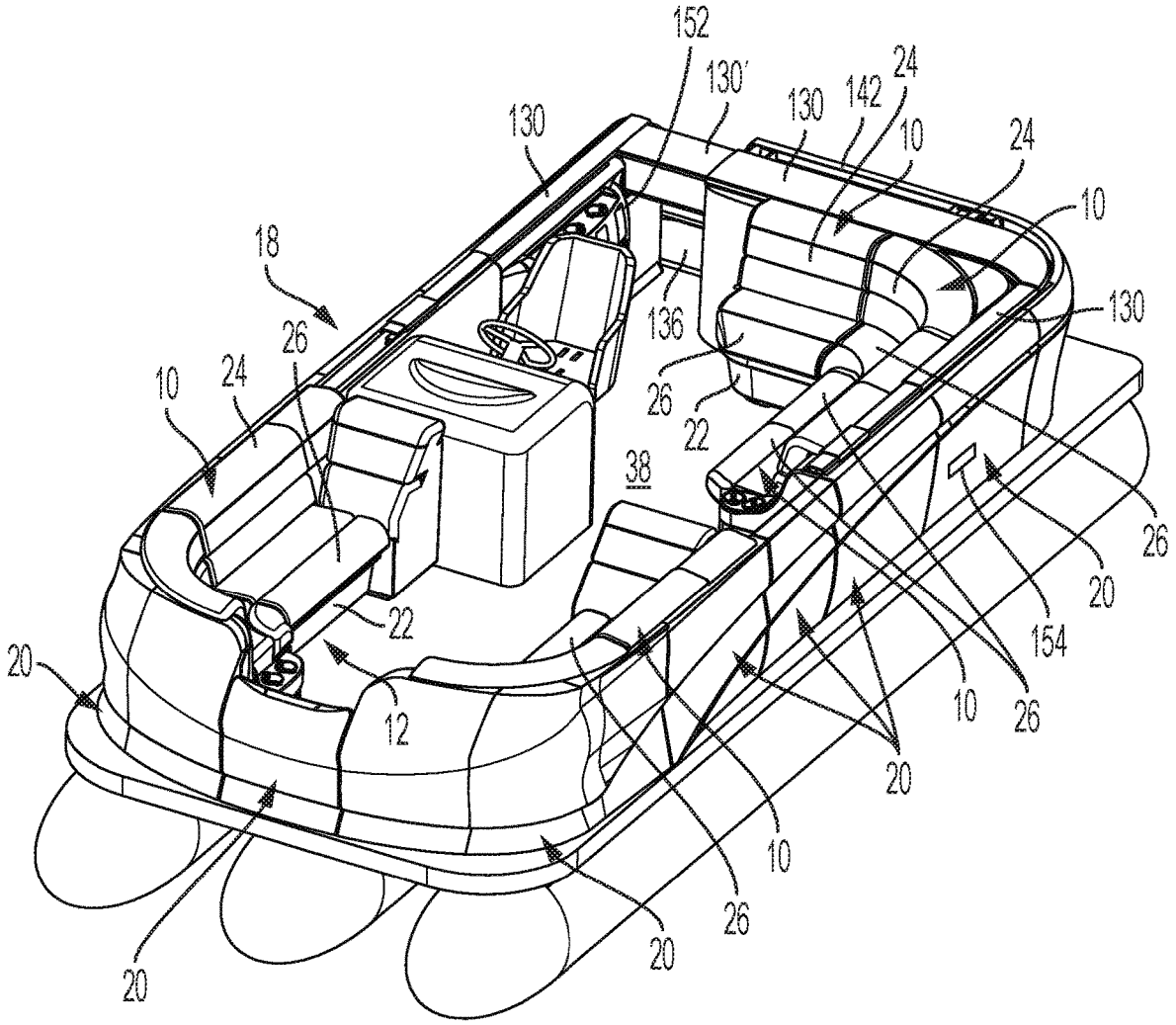
FIG. 1 is a perspective view of a marine vehicle with a seat enclosure.
Figure 2:
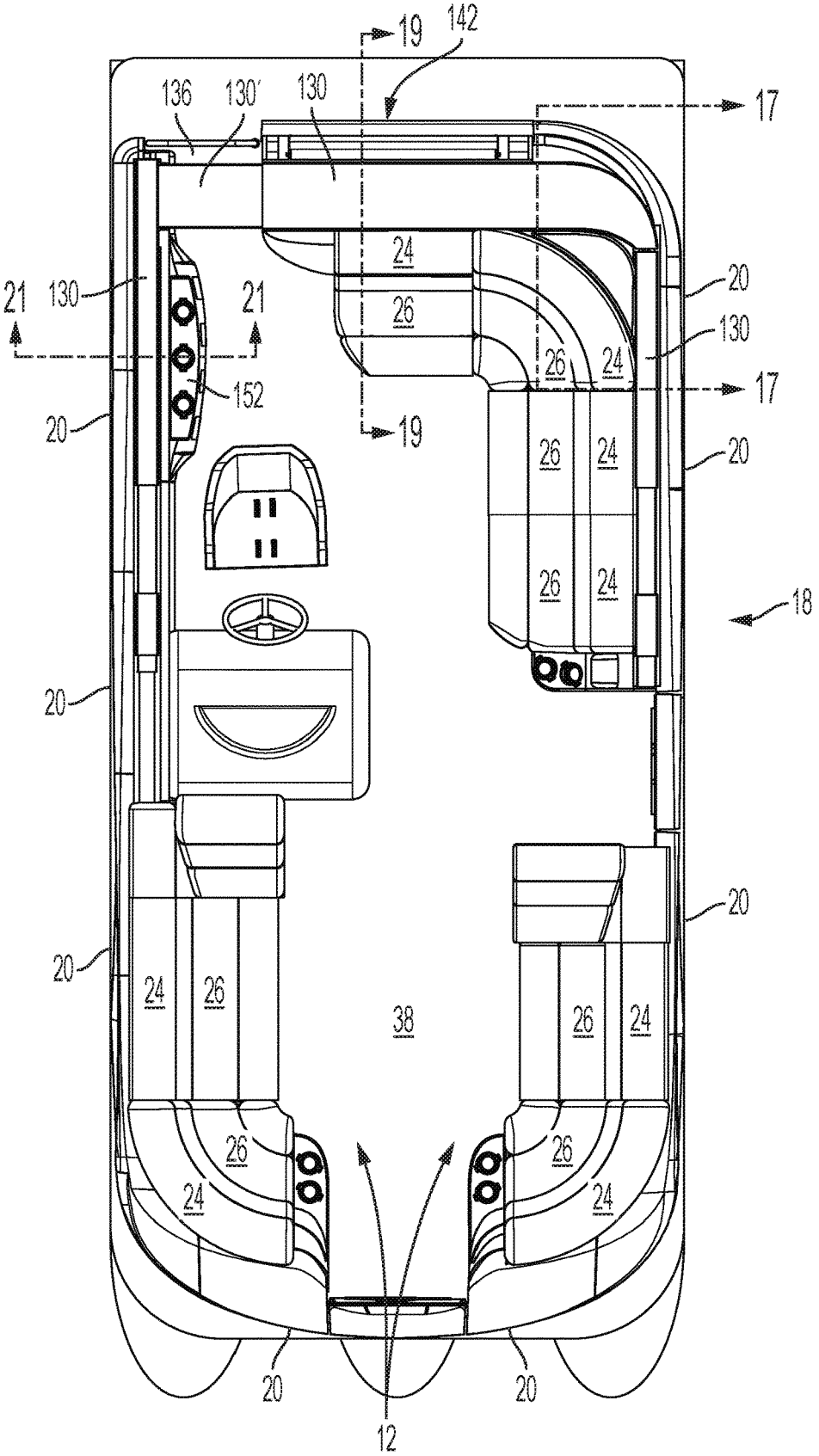
FIG. 2 is a top plan view of a marine vehicle with a seat enclosure.
Figure 3:
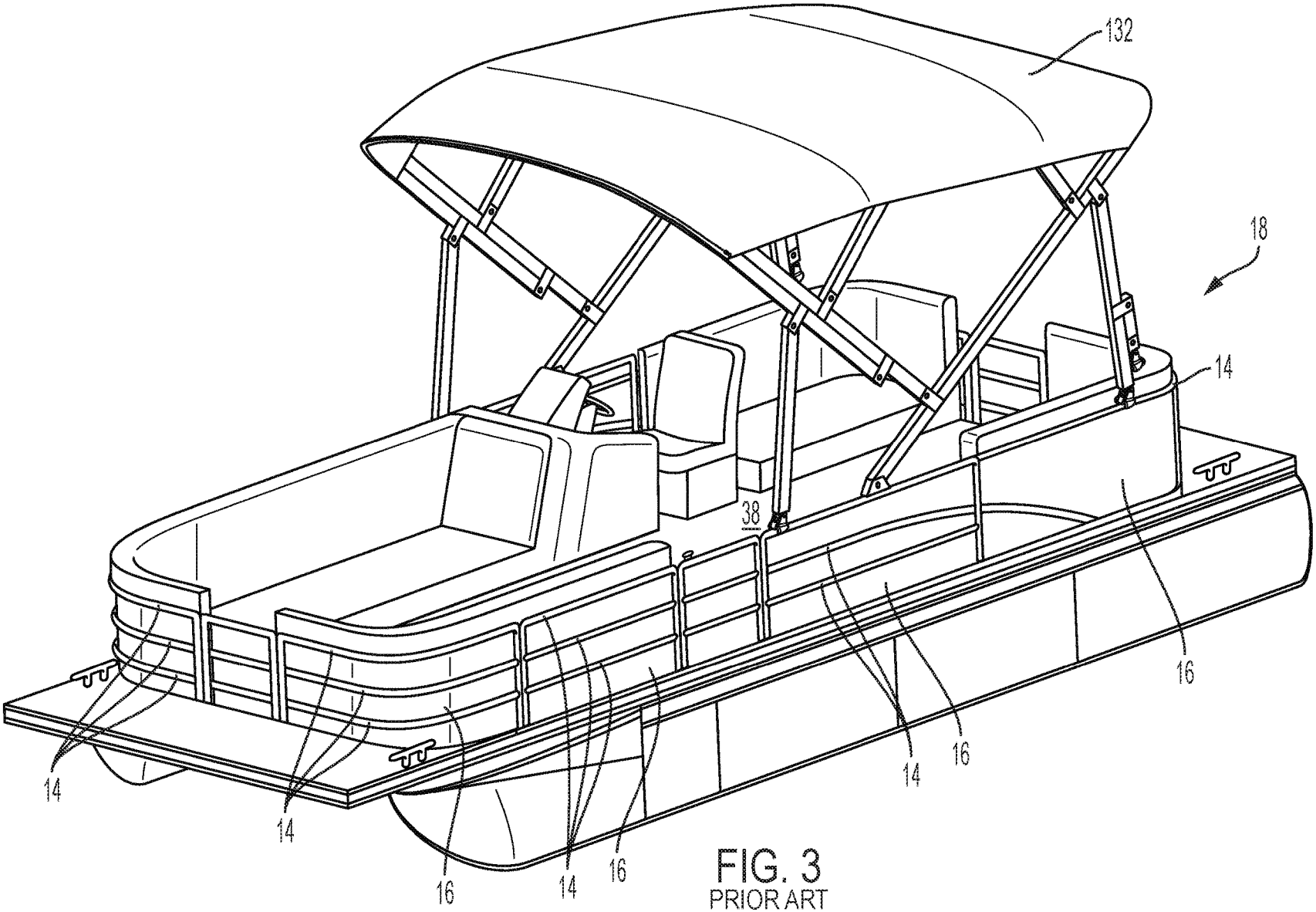
FIG. 3 PRIOR ART
FIG. 3 is a perspective view of a marine vehicle with a prior art welded tube fence.

The seat(s) or seat structure(s) 10 of the seat system or enclosure 12, seen in FIGS. 1-2, permit the exclusion of the metal tube 14 and facade 16 that is often used on vehicles 18, such as pontoon boats, as seen in FIG. 3. The seat enclosure 12 in FIGS. 1-2 is used as the perimeter barrier. The seats 10 of the seat enclosure 12 may have a panel 20 or panels attached to the backside thereof to protect and conceal the backside of the seats and form a portion of the exterior body of the vehicle to provide a decorative appearance or the seats may be integrally formed with such a panel 20 or decorative exterior. When a plurality of seats 10 are attached to marine vehicle 18, the panels 20 form a decorative exterior for at least a portion of the marine vehicle and may be customizable to provide a variety of different appearances.

Figure 4:
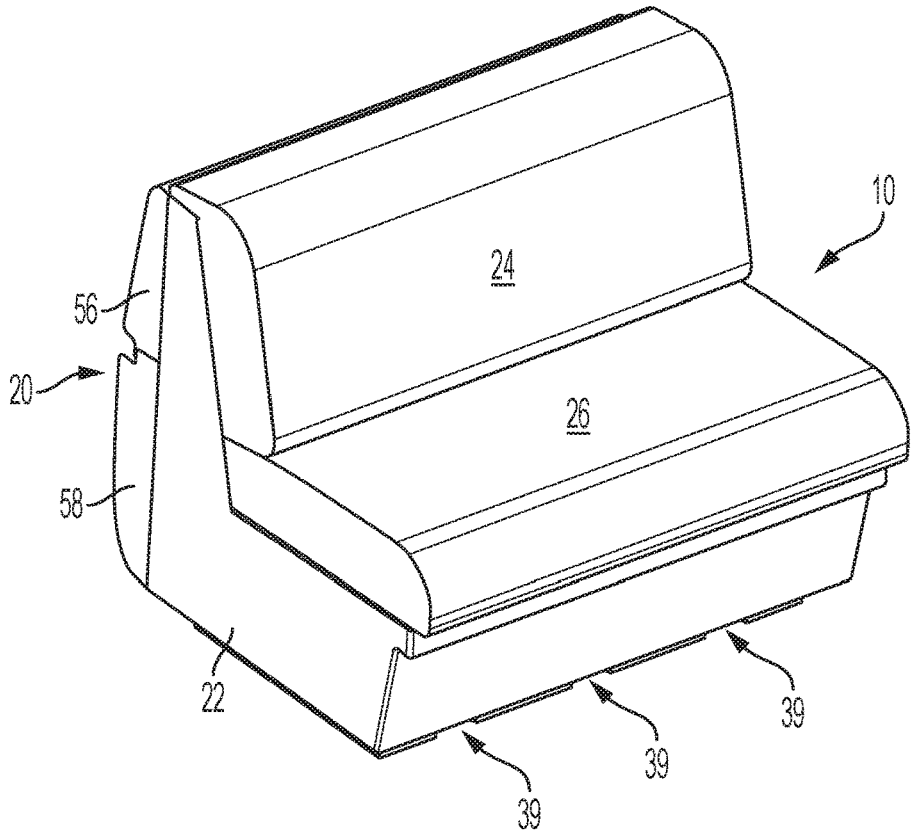
FIG. 4 is a front perspective view of a seat.
Figure 5:
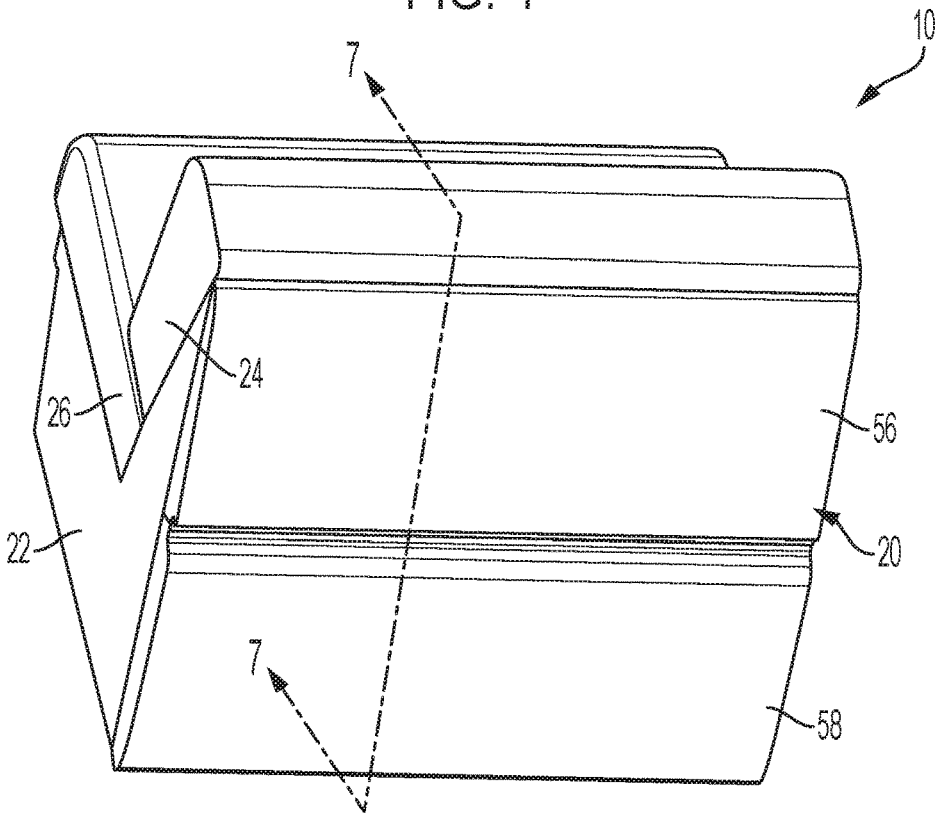
FIG. 5 is a rear perspective view of a seat.

In one embodiment, seen in FIGS. 4-5, the seat 10 includes a base 22, a back cushion or back rest 24 and a seat cushion or bottom rest 26. The base 22 and panel(s) 20 could be integrally formed or formed separately. Further, the panel 20 could include multiple panel portions based upon the look, e.g. multiple colors, and functionality desired.

Figure 6:
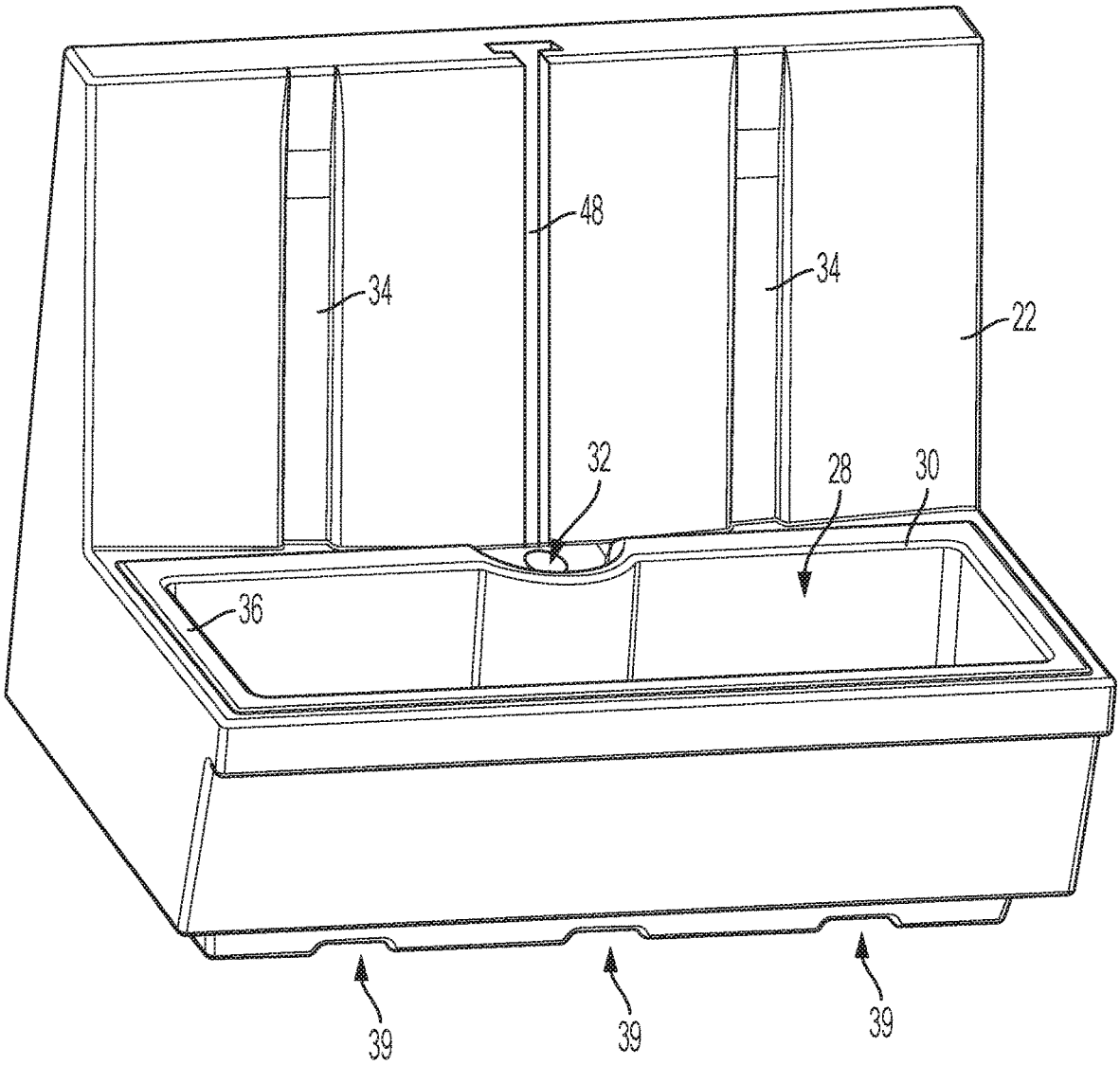
FIG. 6 is a perspective view of a base.

As seen in FIG. 6, the base 22 can be made such that the base has a hollow or partially hollow interior or interior cavity 28 and an opening or orifice 30, formed in the base, to access the interior. The base 22 can also include other features as desired, for example, recesses 34 and/or ridges 36 to add strength and rigidity to the base, passages 39 on the bottom of the seat to permit water from the deck 38 to run under the seat (or from one side of the seat to another side of the seat) and off the exterior perimeter of the deck, and/or a drainage tube 32 to permit any water that reaches the seating surface of the base to drain.

In one embodiment, the base is made from a rotomolded from a plastic material, such as a linear low-density polyethylene. While the panel 20 could be integrally formed with the base 22, rotomolding generally does not result in a smooth or finished looking surface. Further, rotomolding is generally limited to a single color of material and is not conducive to having sharp corners, which limits the design choices. Therefore, while rotomolding is sufficient and cost-effective for a structure, such as a base, it is not as desirable for creating decorative designs, for example, the exterior of a marine vehicle. As such, creating panels 20 separately from the base can be advantageous. The base could also be made from other materials known in the industry, for example, wood, metal, plastic, etc. and/or from other known methods, for example injection molding and three dimensional printing, the use of which would not defeat the spirit of the invention.

Figure 7:
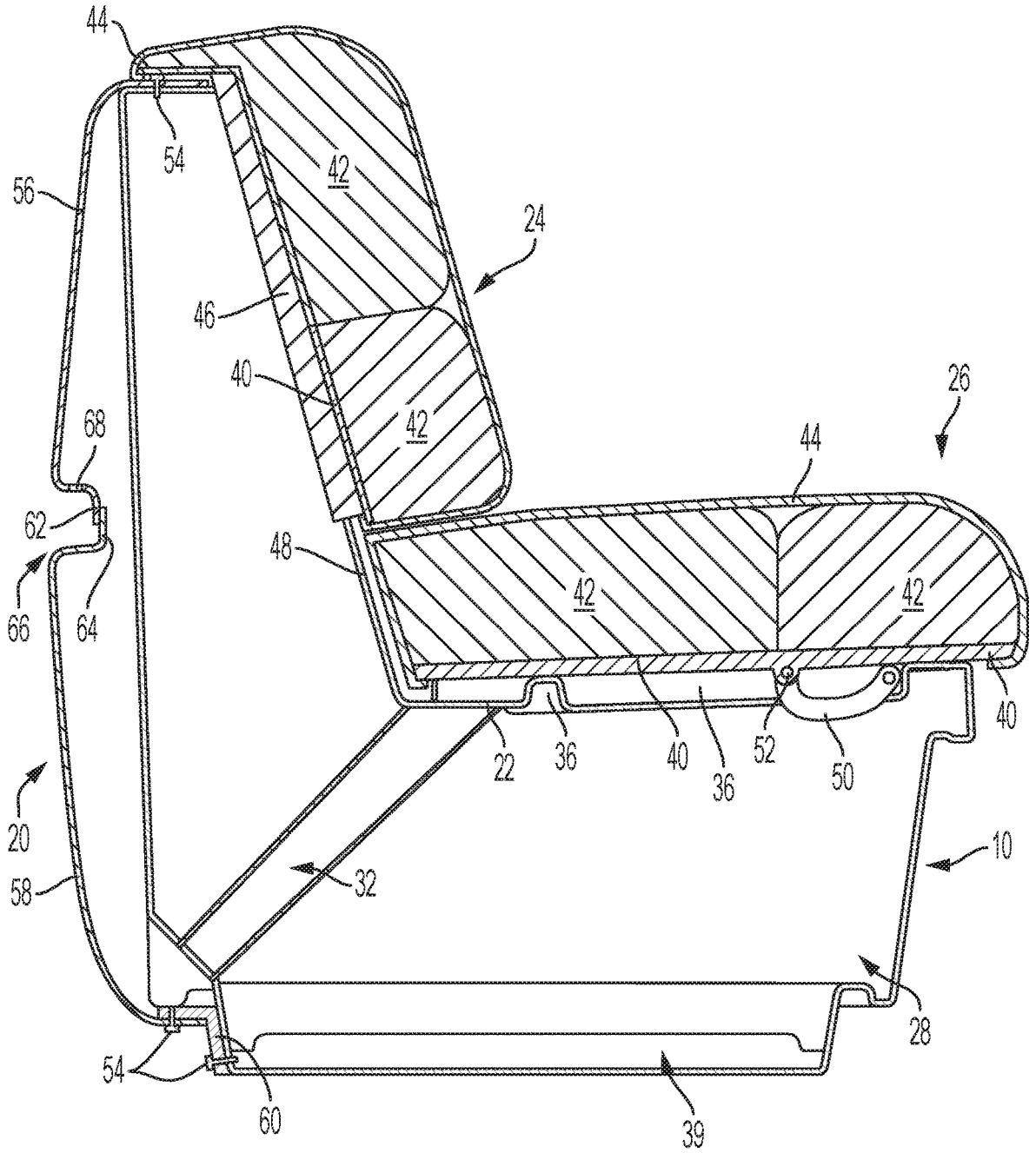
FIG. 7 is a cross-sectional elevation view of the seat of FIG. 5 taken from the line 7-7.

As seen in FIG. 7, a seat cushion 26 and back cushion 24 can be attached or connected to the base 22. The back cushion 24 and or seat cushion 26 can include a board 40, which can be made from any desired material and in one embodiment is made from a high-density polyethylene. A foam material 42 is attached to the board 40 and a cover material 44 is stretched over the top of the foam material 42 and is attached to the back side of the board 40, such as by staples. The foam material 42 can be a single piece of material or multiple pieces of material, as seen in FIG. 7, to achieve the desired performance, comfort and/or appearance. The foam material 42 can be attached or connected to the board 40 by the cover material 44 and/or by other known means of attaching a foam material to a board for example, stapling, gluing, welding, riveting, etc., the use of which would not defeat the spirit of the invention.

In one embodiment, the back cushion 24 is attached to the base 22, by a inverted 'T' shaped projection 46, formed in the board 40 of the back cushion, as seen in FIG. 7, that slides into, and located in, a corresponding inverted 'T' shaped slot 48 formed in the base, as seen in FIG. 6. However, the back cushion 24 could be attached or connected to the base 22 by other known means of attaching a cushion to a base for example, fastening (by screws, bolts or Christmas tree or other barbed fasteners), gluing, welding, fusing riveting, etc., the use of which would not defeat the spirit of the invention.

Figure 8:
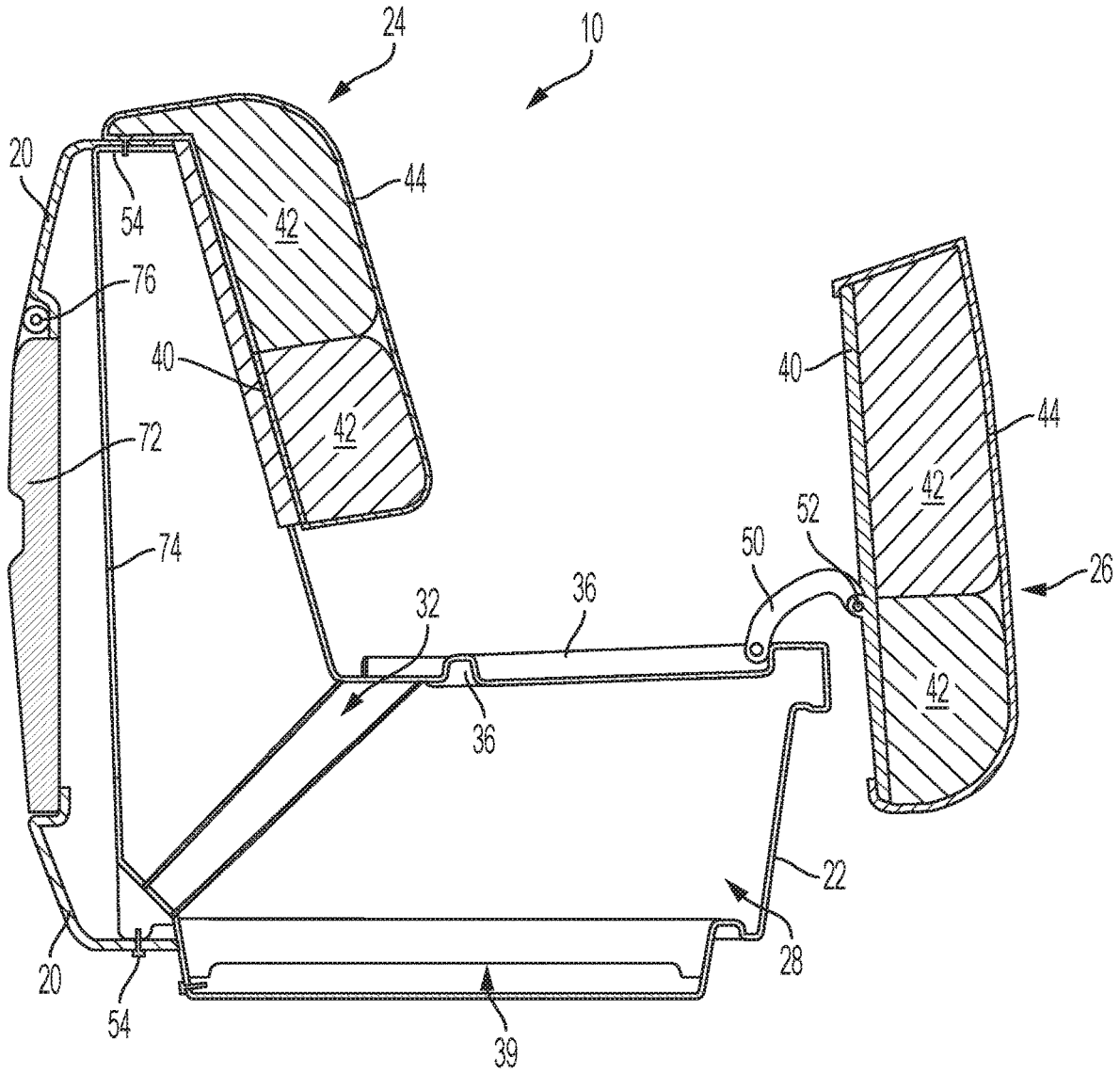
FIG. 8 is a cross-sectional elevation view of an alternative embodiment of a seat.

As seen in one embodiment shown in FIG. 8, the seat cushion 26 is attached, e.g. pivotally attached, to the base 22 by at least one hinge 50 such that the seat cushion 26 may be rotated out of the way of the opening 30 and the interior cavity 28 can be accessed. Alternatively, for example, the seat cushion 26 could be removable, such as by having a projection that sits inside the opening 30 to removably attach the seat cushion to the base 22. By way of another alternative example, the seat cushion 26 could be connected to the front edge of the base 22, by, for example, a piano type hinge or the seat cushion 26 and back cushion 24 cold rotate away from the base 22 together. The above examples illustrate a seat cushion 26 that can be moved between a first position, for example as seen in FIG. 7, wherein the seat cushion covers the opening 30 and can be used to sit on and a second position, for example as seen in FIG. 8, wherein the seat cushion generally does not cover the opening and can be located to a position in front of the base 22. Additional means of removably or rotatably attaching a cushion to a base are known in the art, the use of which would not defeat the spirit of the invention.

In the embodiment seen in FIG. 7, a double pivot hinge 50 is attached at a first hinge end to a support 52 formed in or attached to the underside of the board 40. The second hinge end is attached to the inside of one side of the ridge 36 adjacent the opening 30. A hinge 50 could be located at each side of the seat cushion 26 to provide proper rotation while at the same time not being in the way when accessing the interior cavity 28. The seat cushion 26 could contact the ridge 36 when the seat cushion is in first, seated or down, position.

In FIG. 7, a top or first panel section or portion 56 and a bottom or second panel section or portion 58 cooperate to form a decorative exterior perimeter to the vehicle 18 and/or deck 38. In FIG. 7, the top panel section 56 is attached to the top of the base 22 by a first end of the top panel section and hidden or concealed by the back cushion 24. A bracket 60, such as piece of angle iron, is attached to the backside of the base 22 adjacent a bottom portion, such as by a screw 54 into the base below the cavity 32 in the base. The first end of the bottom panel section 58 is attached to the angle iron 60 by a screw 54. Other means are known for attaching angle iron 60, such as by welding, gluing, riveting, molding the base with the angle iron, etc., the use of which would not defeat the spirit of the invention. The second end of the bottom panel section 58 may be attached to the second end of the top panel section 56.

The use of angle iron 60 prevents the sharp end of the screw 54 from the bottom panel section 58 from being inside the cavity 32. Alternatively, the bottom panel section 58 could be extended such that it attaches to the bottom of the base 22, below the cavity 32 in the base. Further, components other than angle iron could be used, such as, for example, by making the wall of the base thicker at the point where the screw 54 attached such that the point of the screw does not extend into the cavity.

While the above embodiments illustrate the use of screws to attach the panel 20, top panel section 56 and a bottom panel section 58, such components could be attached using bolts, rivets, glue, welds, integral forming, etc., the use of which would not defeat the spirit of the invention. However, forming the panels separately from the base 22, allows the panels to be easily and cost effectively replaced, such as if they are damaged or if a new look is desired, without having to replace the entire seat 10.

In FIG. 8, a single panel 20 may be attached to the back of the base 22 to form a decorative exterior to the vehicle. The panel 20 is attached to the top of the base 22, such as, for example, by a screw 54. The back cushion 24 is placed over the top of the base 22 and a portion of the panel 20 such that the screw 54 is hidden from sight, but still accessible. The bottom of the panel 20 is attached to the bottom of the base 22, such as at a top surface of a recess formed in the base by a screw 54. Locating the screw 54 on the underside of a recess, helps make the screw less noticeable, but still accessible.

In the embodiment seen in FIG. 7, top panel section 56 has a first bend forming a first tab 62 and the bottom panel section 58 has a second bend forming a second tab 64. The tabs 62, 64 are attached or, in this example adhered, to each other by adhesive in FIG. 7, to form an indentation 66. However, other means for attaching panels are known in the art, such as by bolts, rivets, welds, etc., the use of which would not defeat the spirit of the invention. The bends in the top panel section 56 and a bottom panel section 58 also provide additional rigidity and strength.

A slot 68 is formed in the top panel section 56 embodiment shown in FIG. 7, to which access is provided by the indentation 66. The slot 68 can be used, for example, to attach a cover, dock bumpers, a channel, or other accessories. Alternatively, the slot 68 could be located in the base 22 or the bottom panel section 58. The slot 68 can be shaped and sized such that it cooperates with clips for accessories such as a cover or dock bumper, for example those clips disclosed in U.S. patent application Ser. No. 14/606,735, filed on Jan. 27, 2015, which is incorporated herein for all purposes.

Alternatively, one of the top panel section 56 and/or bottom panel section 58 could be without the bend such that the end of the panel section is adjacent the end of the other panel section or both of the panel sections could be without the bends such that the ends of the panel sections are adjacent to or butt ends with one another.

Figure 9:
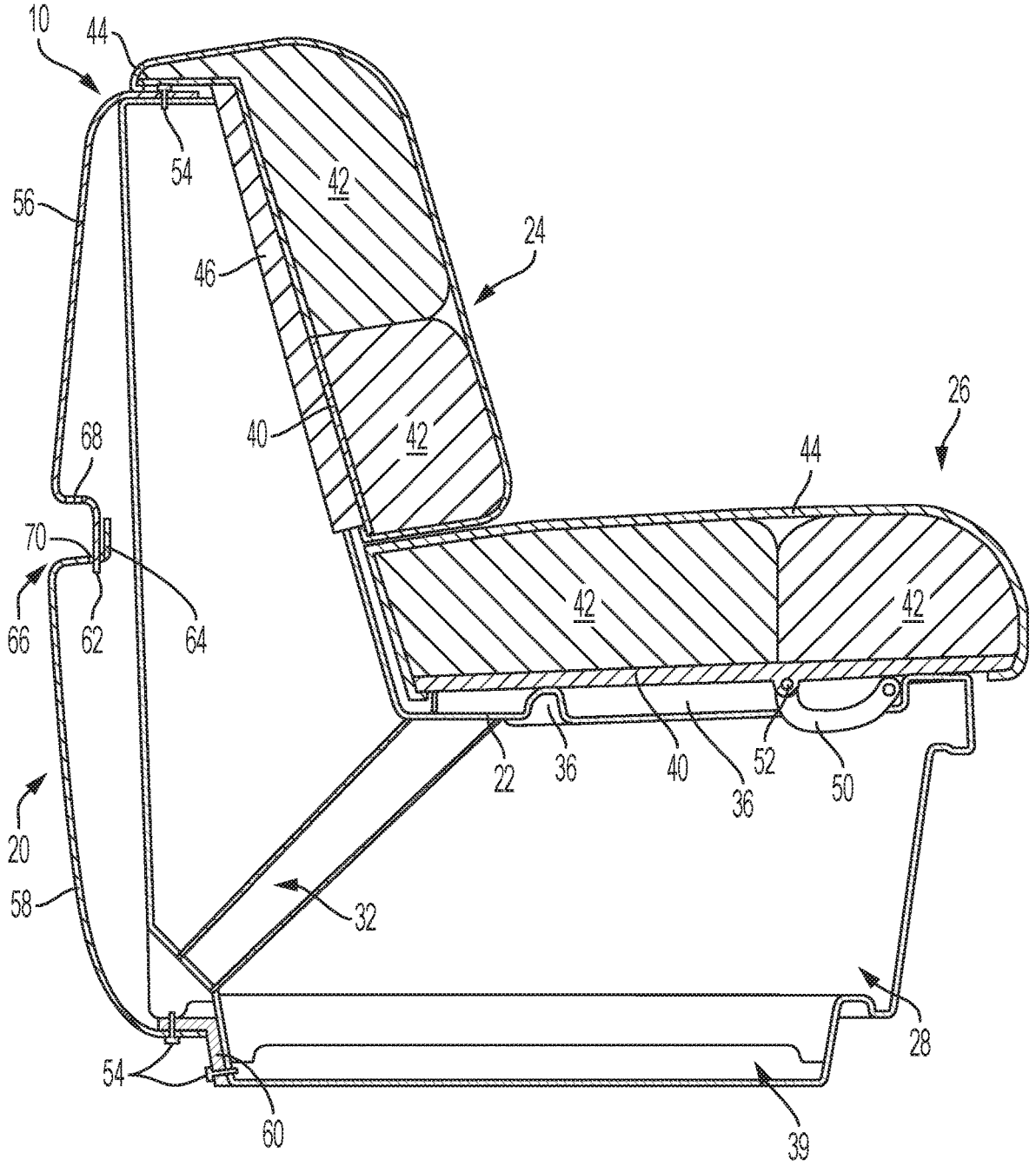
FIG. 9 is a cross-sectional elevation view of an alternative embodiment of a seat.

In another embodiment, seen in FIG. 9, the top panel section 56 could attach to the bottom panel section 58 by having the tab 62 at the second end of the top panel portion within or extend through or into a hole or opening 70 formed in the bottom panel portion. Using an opening and tab connection allows the ends of the bottom panel portion 58 and top panel portion 56 to be hidden and eliminates the use of a mechanical fastener, such as a screw. In the alternative embodiment seen in FIG. 9, the bottom panel section 58 attaches to the base 22 by a fastener at a first and second end of the bottom panel section and the top panel section 56 is attached to the base at a first end by a fastener. However, other attaching means could be used, for example, glue, welds, etc., the use of which would not defeat the spirit of the invention. Further, although a top panel section 56 and a bottom panel section 58 are shown in FIGS. 7 and 9, the two or more panels could be connected side by side for a single seat 10 or to connect one seat enclosure to another seat.

In one embodiment, the panel 20, top panel section 56 and/or bottom panel section 58 may be made of vacuum formed plastic material, such as, for example, an acrylonitrile butadiene styrene material The panel(s) could also be made from known materials for example, thermoplastic olefin, thermoplastic polyurethane, acrylic, acrylic capped acrylonitrile butadiene styrene, thin film laminate acrylonitrile butadiene styrene, polystyrene, polycarbonate, polypropylene, liquid crystal polymer, etc., the use of which would not defeat the spirit of the invention. The use of plastic has significant cost savings over the current fiberglass or tube fence systems and provides a similar luxury look as compared to fiberglass. Additional costs savings can be realized if the base 22 is also made from plastic.

In the embodiment seen in FIG. 8, the back of the seat 10 includes an access door or flap 72 that provides access to the interior cavity 28 of the base 22. Alternatively, the access door 72 could provide access to the space between base 22 and panel 20 through an aperture formed in the panel. If access to the interior cavity 28 is desired an opening 74 in the backside of the base 22 can be provided. The access door 72 could be instead of or in addition to access (thereby a second opening) to the interior cavity 28 through the opening 30. Further, the hollow interior 28 could be partitioned such that the access door 72 provides access to a first compartment of the hollow interior and the opening 30 provides access to a second compartment of the hollow interior. For example, the access door 72 could be movable between a first or closed position such that the access door covers the aperture (as seen in FIG. 8) and a second or open position wherein the access door generally does not cover the aperture to provide access to the interior cavity 28 or to the space between base 22 and panel 20. The access door 72 could be rotatably attached to the panel 20 by a hinge 76 or could be removably attached to the panel such as, for example, by snapping on/off of the panel.

Providing access to the hollow interior 28 from outside the marine vehicle 18 allows for loading and unloading of the marine vehicle without having to board the marine vehicle first, such as, for example, when the marine vehicle is on a trailer or from the dock when the vehicle is docked. The access door 72 can also provide for storage of items typically used outside of the marine vehicle 18, such as, for example, dock bumpers or fenders. The rope for the fender could remain mounted to the storage area, marine vehicle or other structure when the fender is stored in the storage area, such that the fender can be deployed without having to be untied. Such access doors or flaps and storage areas allow for quicker deployment of the fenders and allows previously used space for storing fenders, such as the deck of a marine vehicle, free for other uses.

Figure 10:
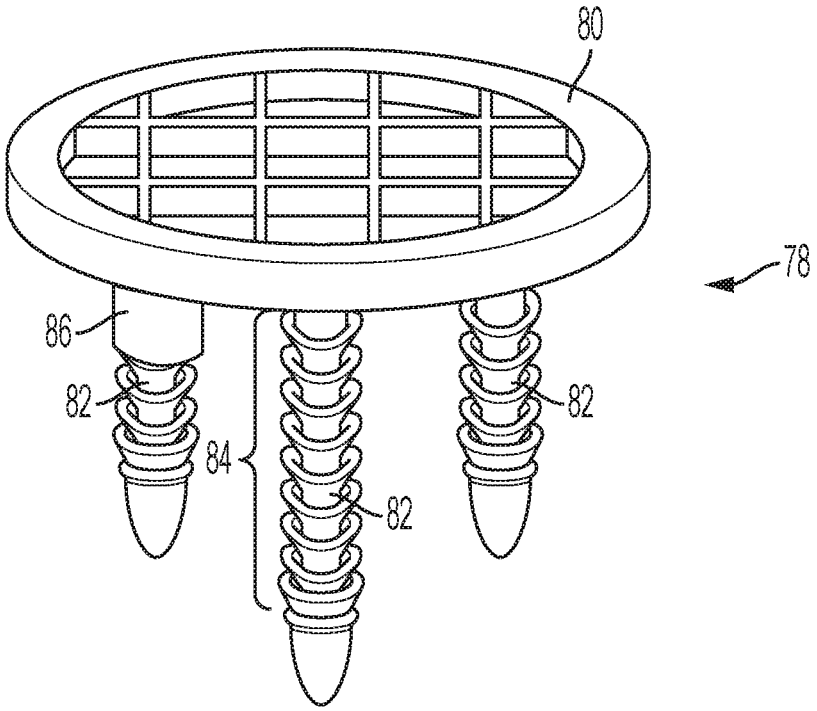
FIG. 10 is perspective view of a fastener.

In alternative embodiment, components such as, for example, the panel 20, top panel section 56, bottom panel section 58, back cushion 24 and/or seat cushion 26, could be attached to the base 22 through the use of a fastener 78, such as the push in fasteners shown in FIG. 10. The fastener 78 includes flat head 80 with at least one leg 82, and in the embodiment shown, three legs. The head 80 can be used to attach a component to the fastener 78. In one embodiment, glue is applied to the head 80 and then the head is put into contact with the component to attach the fastener 78 to the component. The at least one leg 82 is inserted into a hole drilled into the base 22. The at least one leg 82 could have barbs 84, or other means known in the industry, e.g. ridges, indentations, split legs, etc., the use of which would not defeat the spirit of the invention, to keep the at least one leg and, thereby, the fastener 78 from coming out of the hole after being installed.

Using three legs 82, as seen in the embodiment shown in FIG. 10, helps the joint surface or head 80 be more stable and have less movement than if the fastener 78 had only one leg. The head 80 may also have a textured pattern, for example honeycomb, on its face to provide better adhesion such as by having more contact surface, channels and/or spaces for the glue so that it does not all squeeze out. The fastener 72 could also include a shoulder 86 on the at least one leg 82 to limit the insertion travel into the hole or on the head 80 to provide a stand-off glue surface allowing versatility in the mounting plane of the component. Further, making the component and fastener 72 from the same material, such as acrylonitrile butadiene styrene, may provide for a stronger bond.

Figure 11:
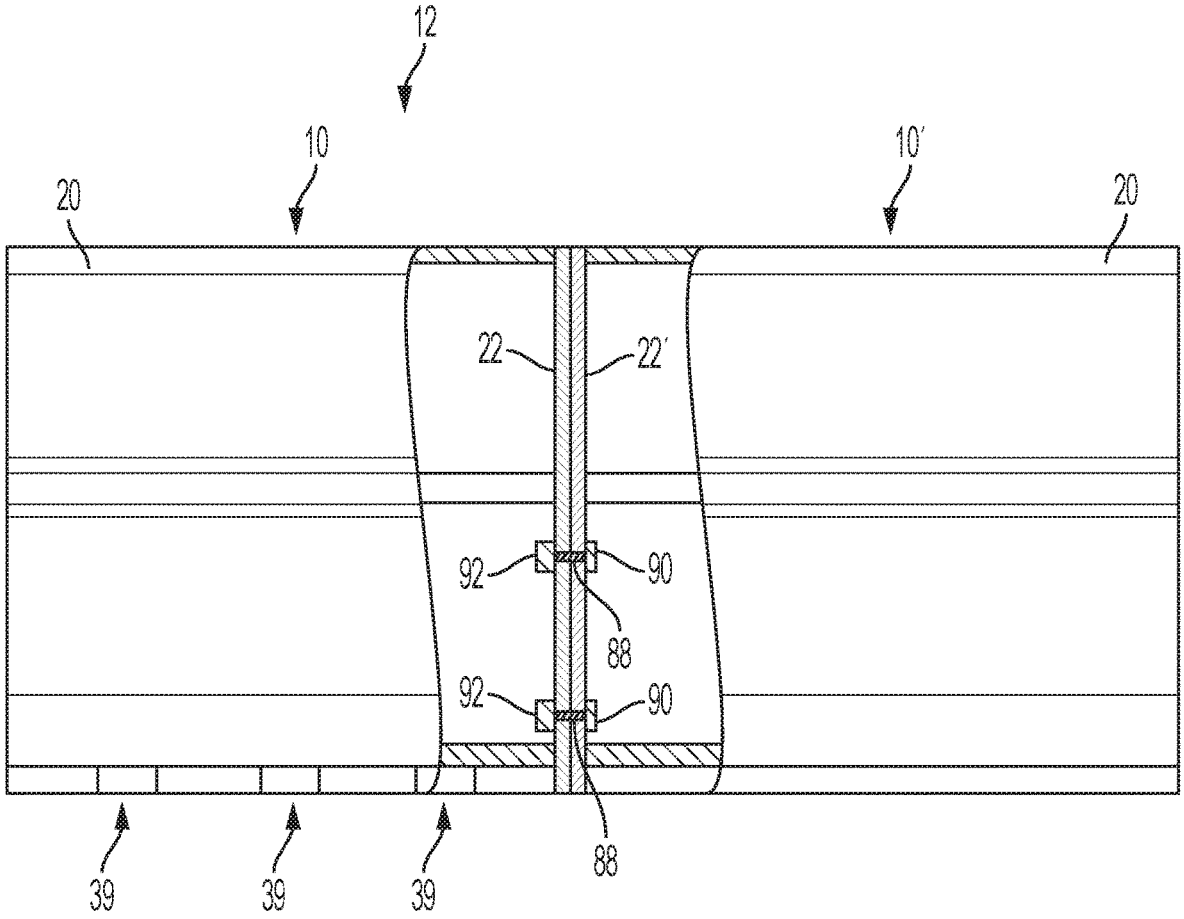
FIG. 11 is an elevation view of two seats with a portion of the back and panels removed.

As seen in FIGS. 1-2, the marine vehicle 18 can include a number of seats 10. Referring to FIG. 11, to connect one seat 10 to another adjacent seat 10', a hole 88 can be drilled through one sidewall of the base 22 and through the adjacent sidewall of the base 22' for the adjacent seat 10' by accessing the interior cavities 28 of each seat. A bolt 90 can be inserted into the hole 88 from the interior cavity of one seat 10' such that the end of the bolt 90 extends into the interior cavity 28 of the other seat 10. A nut 92 can be threaded onto the end of the bolt 90 from the interior cavity of the seat 10 and tightened to secure the two seats together.

Figure 12:
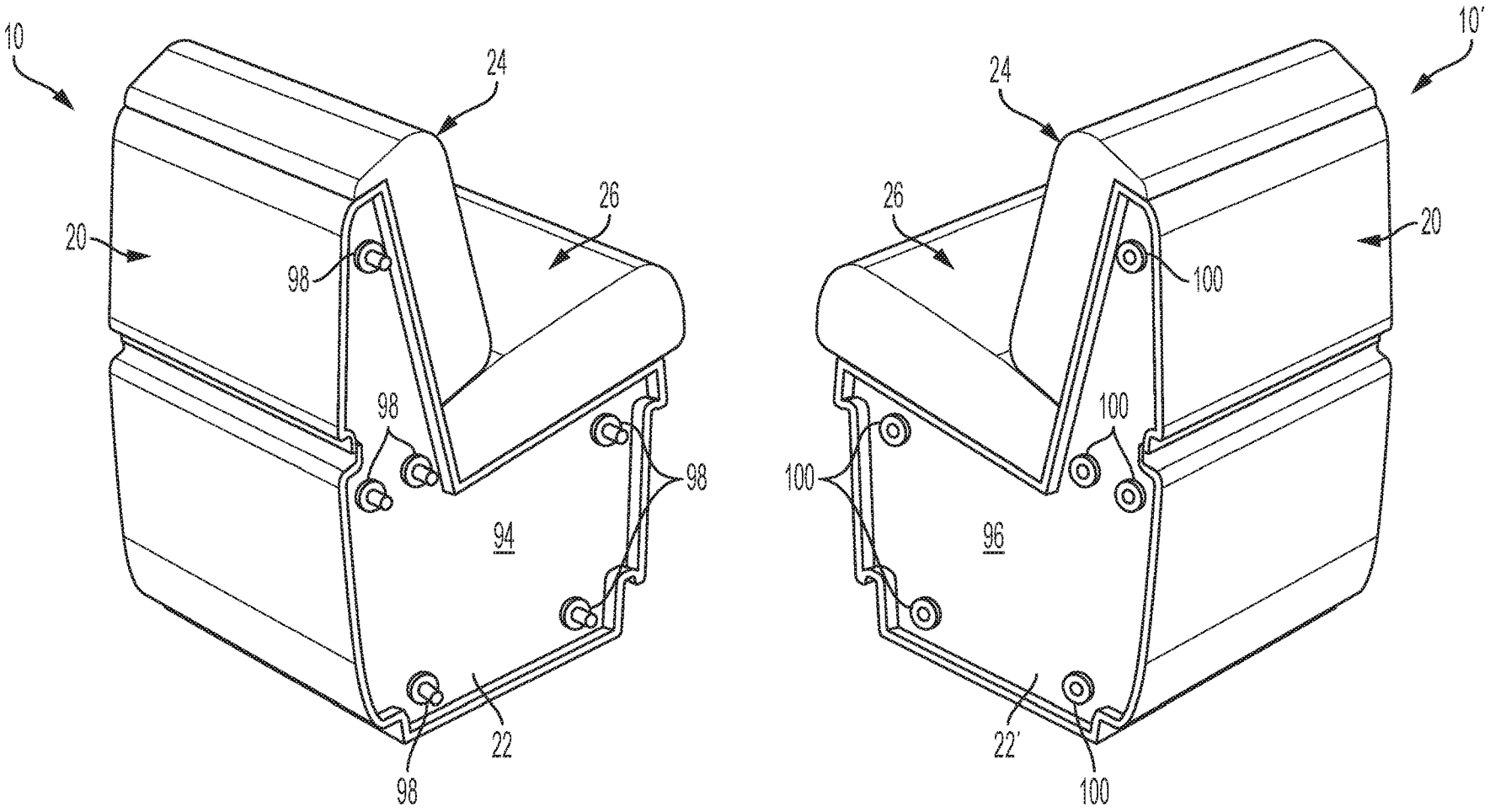
FIG. 12 is an edge perspective view of a first sidewall of a seat and a second sidewall of another seat.

In an alternative embodiment seen in FIG. 12, the seats 10 can be configured to be connected and disconnected through a modular connection system. The embodiment shown in FIG. 12 includes a first seat 10 with a first sidewall 94 on a side of the first seat adjacent a second seat 10'. The second seat 10' has a second sidewall 96 on the side of the second seat adjacent the first seat 10. The first sidewall 94 includes a plurality of posts 98. The second sidewall 96 includes a plurality of bores or holes 100 formed therein that receive the plurality of posts 98 such that the two seats 10, 10' can connect or attach to one another. There are a number of means for connecting two seats together, which are known in the industry, e.g. projections and recesses, slots and tabs, welding, fastening, etc., the use of which would not defeat the spirit of the invention. However, the use of such a modular connection system provides additional efficiency during installation over the use of tube fence systems.

Figure 13:
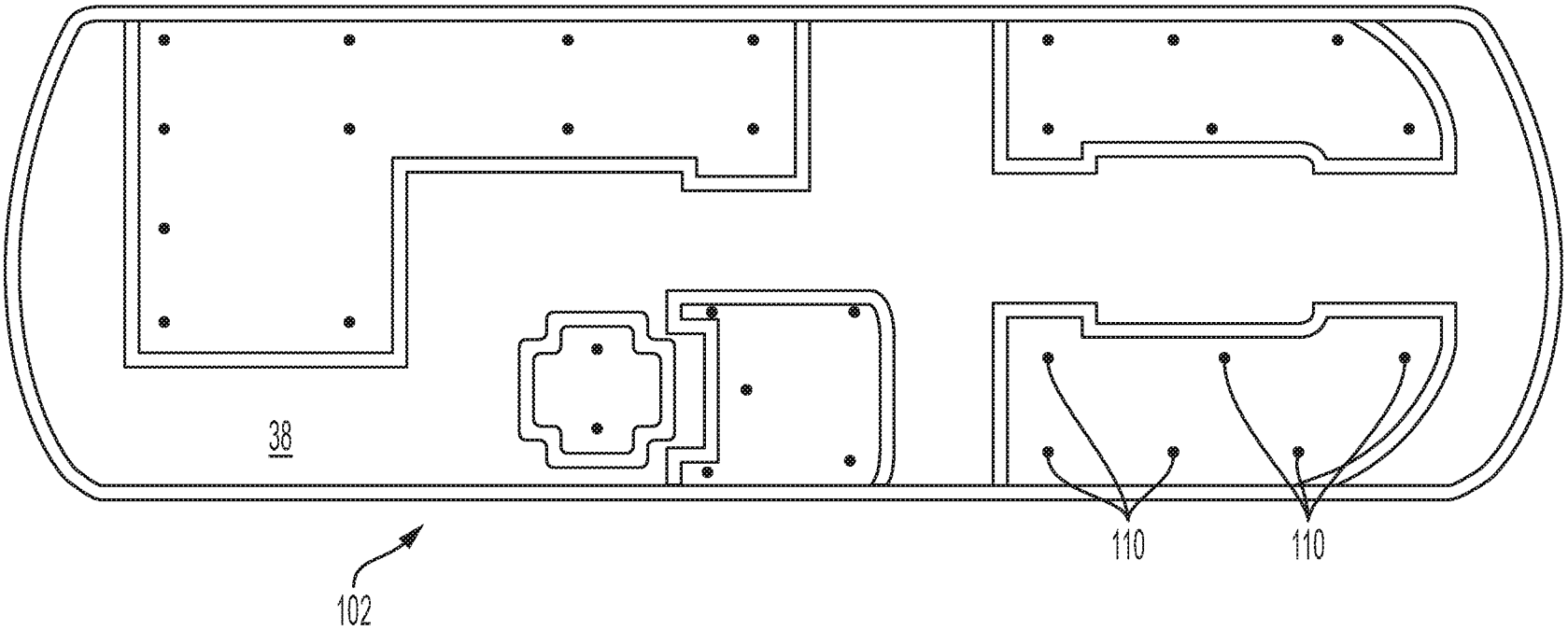
FIG. 13 is plan view of a stencil.
Figure 14:
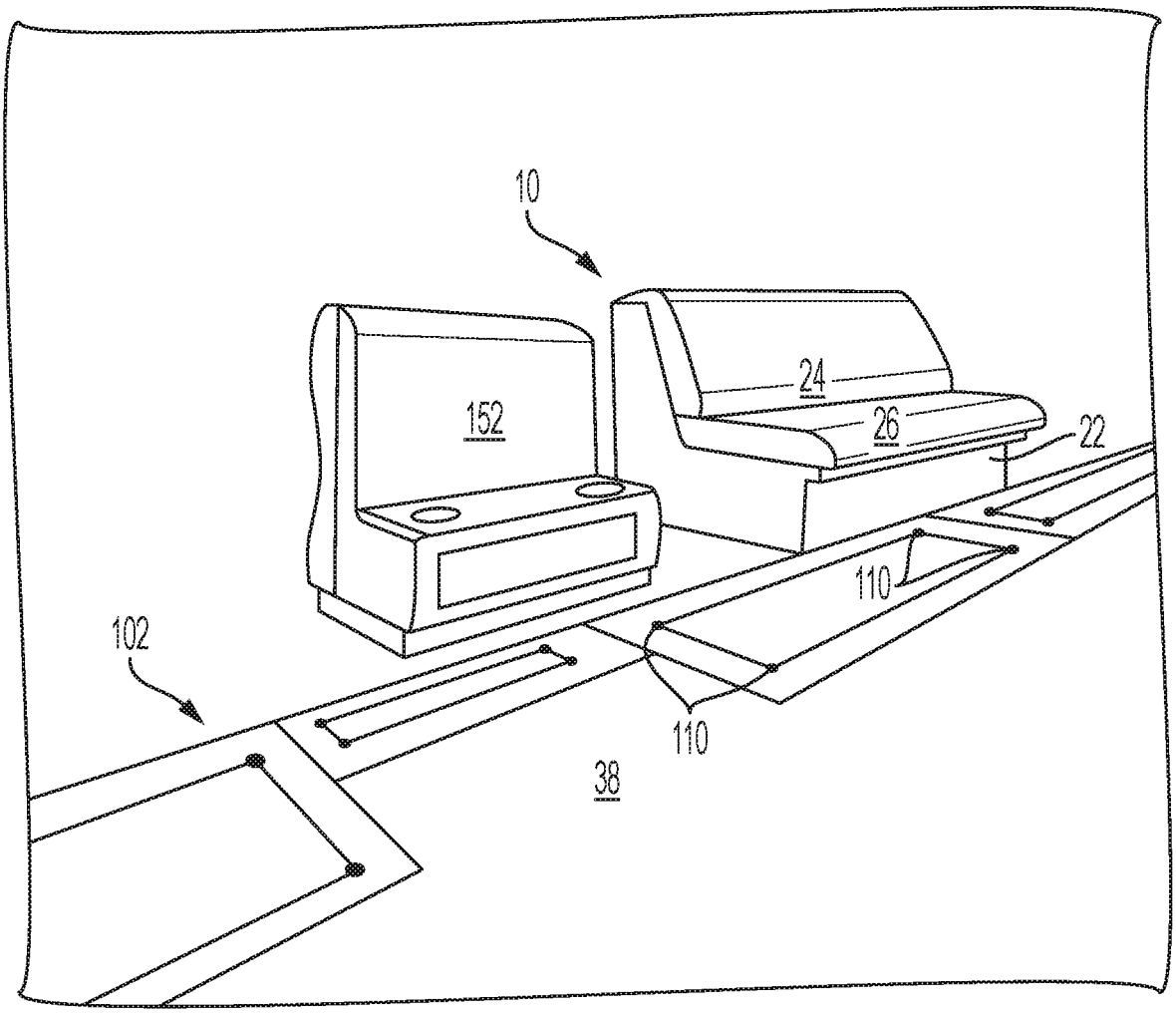
FIG. 14 is a perspective view of a seat being placed on a stenciled deck.

The seats 10 of the seat enclosure 12 may be located on the marine vehicle 18 using a stencil 102. An example of an installation stencil 102 can be seen in FIG. 13. The stencil 102 could be attached or applied to the deck 38 of the marine vehicle 18 or marked, such as by using a CNC plotter or cutter or other marking means, for example paint. The seats 10 could then be placed in the correct location, as identified by the stencil, and secured to the deck 38 as illustrated in FIG. 14.

Once placed on the stencil 102, the seats 10 could be secured to the deck 38 of the marine vehicle 18. In one embodiment, the seats 10 are attached to deck by accessing the interior cavity 28 and fastening through the floor of the base or frame 22 and into the deck 38 such that the panel or panels form a portion of an exterior perimeter of the deck 38.

Figure 15:
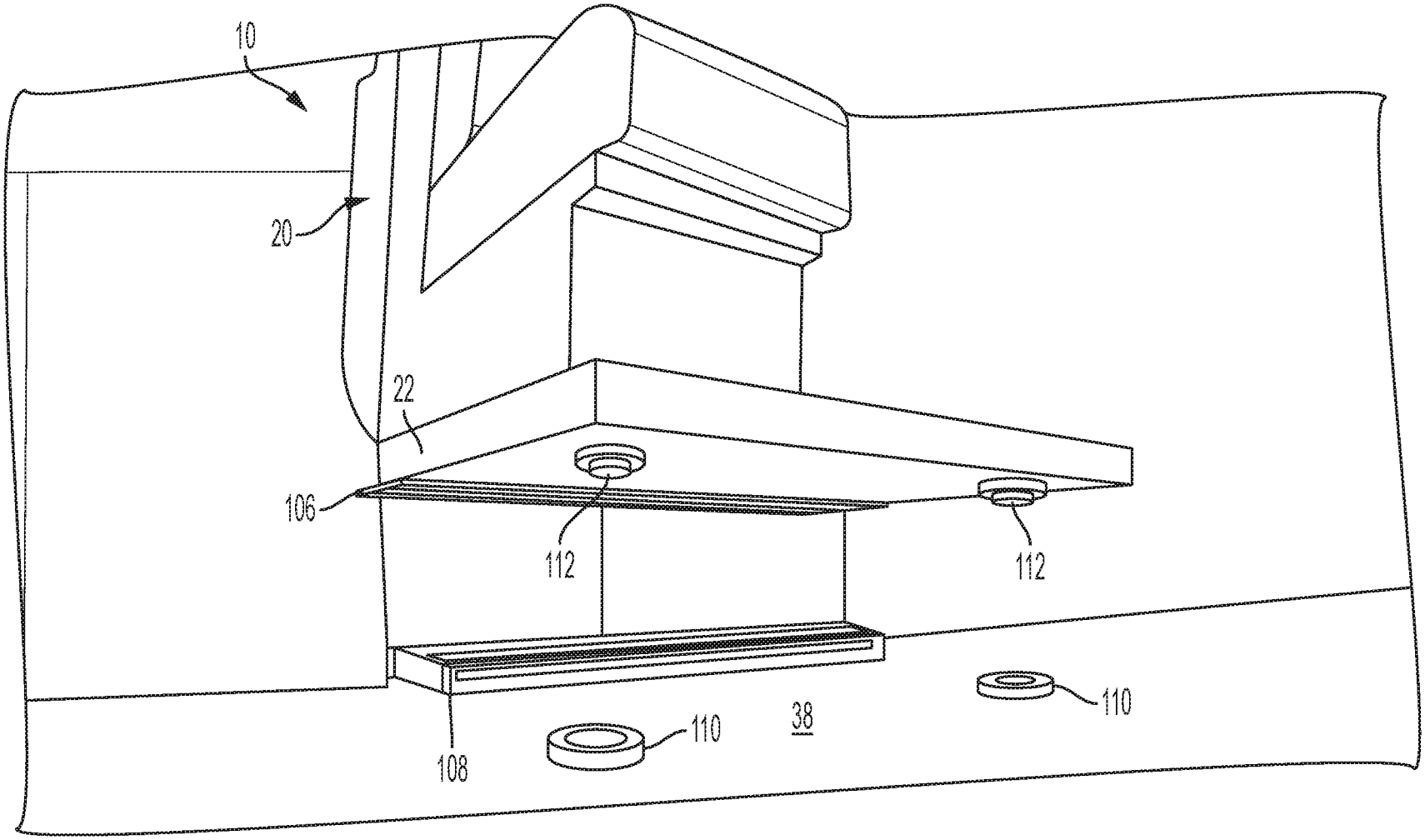
FIG. 15 is a seat being attached to a deck.

The seats 10 could alternatively be attached to a marine vehicle 18 using a jig, e.g. metal tubes, a channel, etc. The jig would be installed onto the floor of the deck 38 and the base 22 of the seat 10 connected to the jig, e.g. mounted on top of, mounted to, etc. One such connection shown in FIG. 15 includes a bracket 106, such as an "L" shaped bracket, on the base 22 that fits into a channel 108 on the deck 38. The seats 10 could also be mounted to stations, which would be mounted to the deck.

Such mounting could be accomplished with or without mechanical fasteners between the base 22 and the station or deck 38. Such methods allow for accurate placement of seats 10 in a more efficient manner resulting in less labor and, thereby, less cost. For example, the embodiment in FIG. 15 includes a receptacle 110 that is mounted to the deck 38 configured to engage a puck 112 that attaches to the bottom of the base 22. When the base 22, and puck 112, is brought down onto the receptacle 110, the puck will be seated in the receptacle. Such receptacles 110 could also be located by a stencil 102 as seen in FIG. 13.

Figure 16:
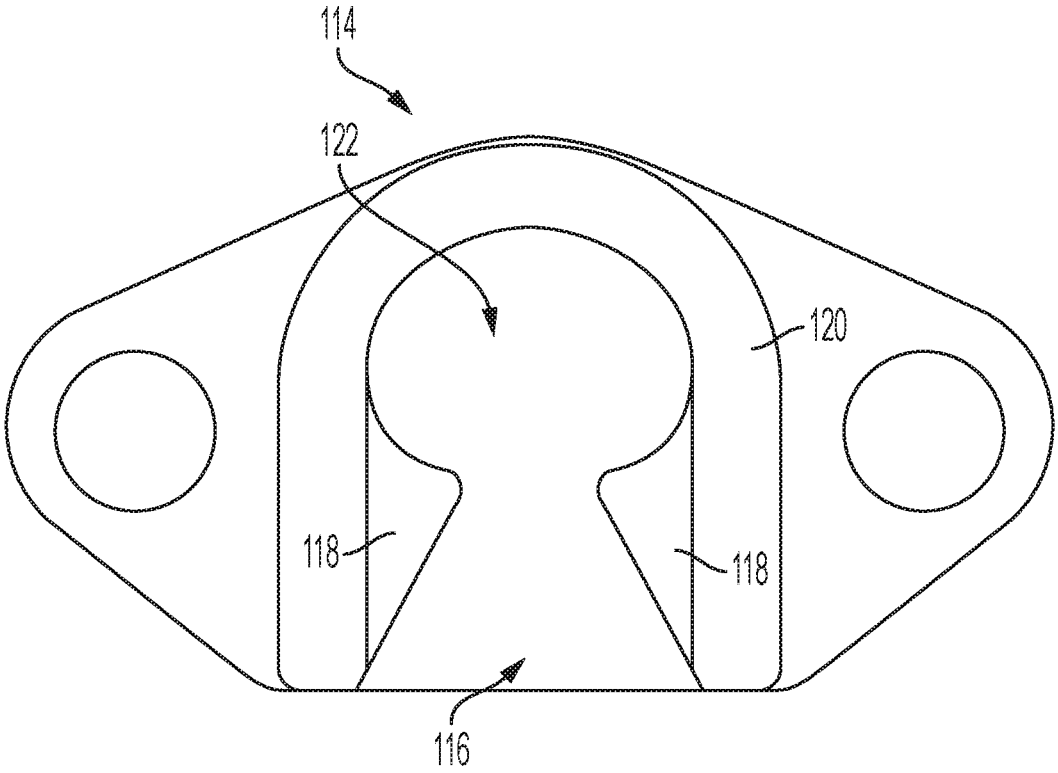
FIG. 16 is a top plan view of a lock snap receptacle.

In another alternative embodiment seen in FIG. 16, a lock snap receptacle 114 could be used instead of or in addition to the bracket 106 and channel 108 connection. As the base 22 is moved into position, in one embodiment towards and into the channel 108, the puck 112 will enter the mouth 116 of the lock snap receptacle 114. As the puck 112 moves further into the mouth 116, the puck 112 will engage at least one toggle 118. As the puck 112 moves through the mouth 116, the puck will push the at least one toggle 118 out of the way and into a housing 120 of the lock snap receptacle 114. Once the puck 112 is moved past the at least one toggle 118 and into the saddle 122, a compressible member, such as a spring, will urge the at least one toggle back out of the housing 120 behind the puck. The at least one toggle 118 will be connected to the housing 120 such that the puck 112 will not push the at least one toggle 118 into the housing 120 when the puck is in the saddle 122. To release the puck 112, the at least toggle 118 can be pushed into the housing from the mouth 116 and the puck pulled from the saddle 122 into the mouth and removed.

As previous mentioned, the panel 20, top panel section 56, bottom panel section 58 and/or access door 72, could can be vacuum formed from plastic. Vacuum forming allows contours in the shape of the components that are not possible with welded aluminum tube fences, but which are less expensive than fiberglass. For example, it may be possible to form a space in the seat(s) 10 at the stern for a bimini top to be stored in, and be "hidden" when it is in the collapsed position. The disguising, hiding or de-emphasizing of the appearance of a bimini top when not in use provides a more luxury look for the marine vehicle. The storage of the bimini top can also be accomplished easier and faster by eliminating the use of a boot.

Figure 17:
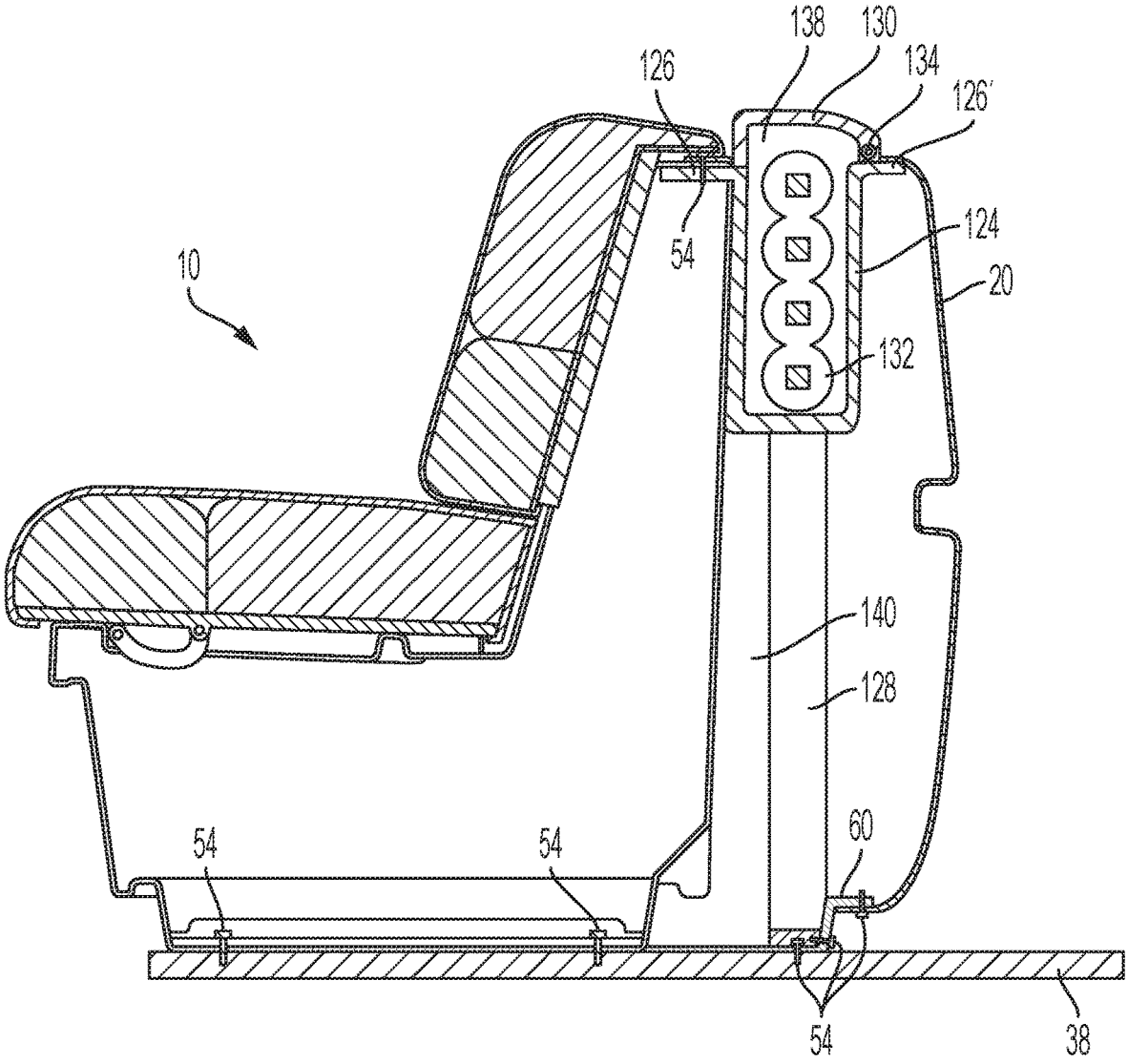
FIG. 17 is a cross-sectional elevation view of a seat embodiment with a bimini trough.

In the example seen in FIG. 17, a trough 124 is attached to the base 22. The trough 124 in FIG. 17 is generally 'U' shaped, forming an interior space, and has a pair of flanges 126. A first flange 126 is attached to the top of the base 22, much like the panel 20 was attached to the base in FIG. 7 and described above and the back cushion 24 placed over the flange 126 to hide the flange. Under the trough 124 is a supporting member 128, such as tubular framing, attached to the trough to support the trough.

In the embodiment seen in FIG. 17, a panel 20 is attached at a first end to the second flange 126', such as by being glued. An angle iron 60 is attached to the supporting member 128 and the bottom of the panel 20 is attached to the angle iron 60, and thereby the supporting member, such as, for example, by a screw.

A cover 130 can be attached to the top of the trough 124 to conceal, disguise or de-emphasize the bimini top 132 located at least partially in the interior space of the trough. In the embodiment shown in FIG. 17, the cover 130 is rotatably attached to the trough by a hinge 134 and movable between a first position wherein the cover conceals the interior space and a second position wherein the cover generally does not conceal the interior space. However, the cover could be removable attached to the trough, such as, for example, by snapping on/off of the cover or otherwise attached to another component of the seat 10 such as the base 22 or panel 20.

Figure 18:
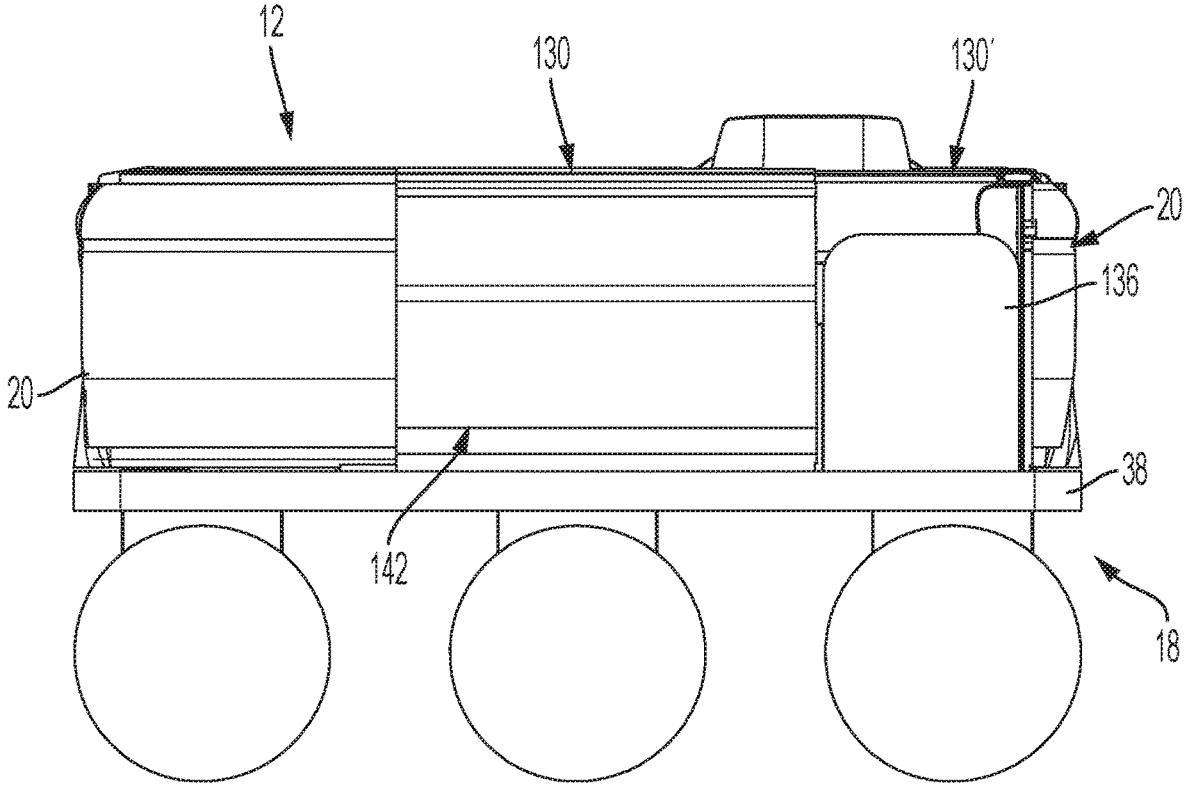
FIG. 18 is a rear elevation view of a marine vehicle.

By way of another example, the cover portion or secondary cover 130' above the stern gate 136, as seen in FIG. 18, is slidably attached or connected to the cover 130 adjacent to it such that if it is desired to use the gate, to enter or leave the marine vehicle 18 while the bimini top 132 is deployed, the cover portion 130' can be slide from the extended position in which it extends away from the cover 130 and into a contracted position in which it is in the space 138 below the cover 130 and into the trough 124 (shown in FIG. 17). As such, the secondary cover 130' can be moved with the cover 130 as discussed above. The gate 136 to can be selectively slid, like a pocket door, into the space 140 between the back of the base 22 and the supporting member 128, providing a space in the perimeter of the marine vehicle 18 to enter or leave the marine vehicle 18. The gate 136 could also or alternatively be attached to the adjacent seat 10 by a hinge so the gate can be swung open and closed. As such, the gate(s) 136 may be moved between a first position in which ingress to the deck 38 is permitted and a second position in which ingress is not permitted and also form(s) a portion of the exterior perimeter if the marine vehicle 18.

Gates 136 could be formed by attaching two panels 20 together, for example, by gluing, welding, fastening, etc. The seams of the gate could also be reinforced such as, for example, by using angle iron or making the material forming the panel thicker near the seams.

Figure 19:
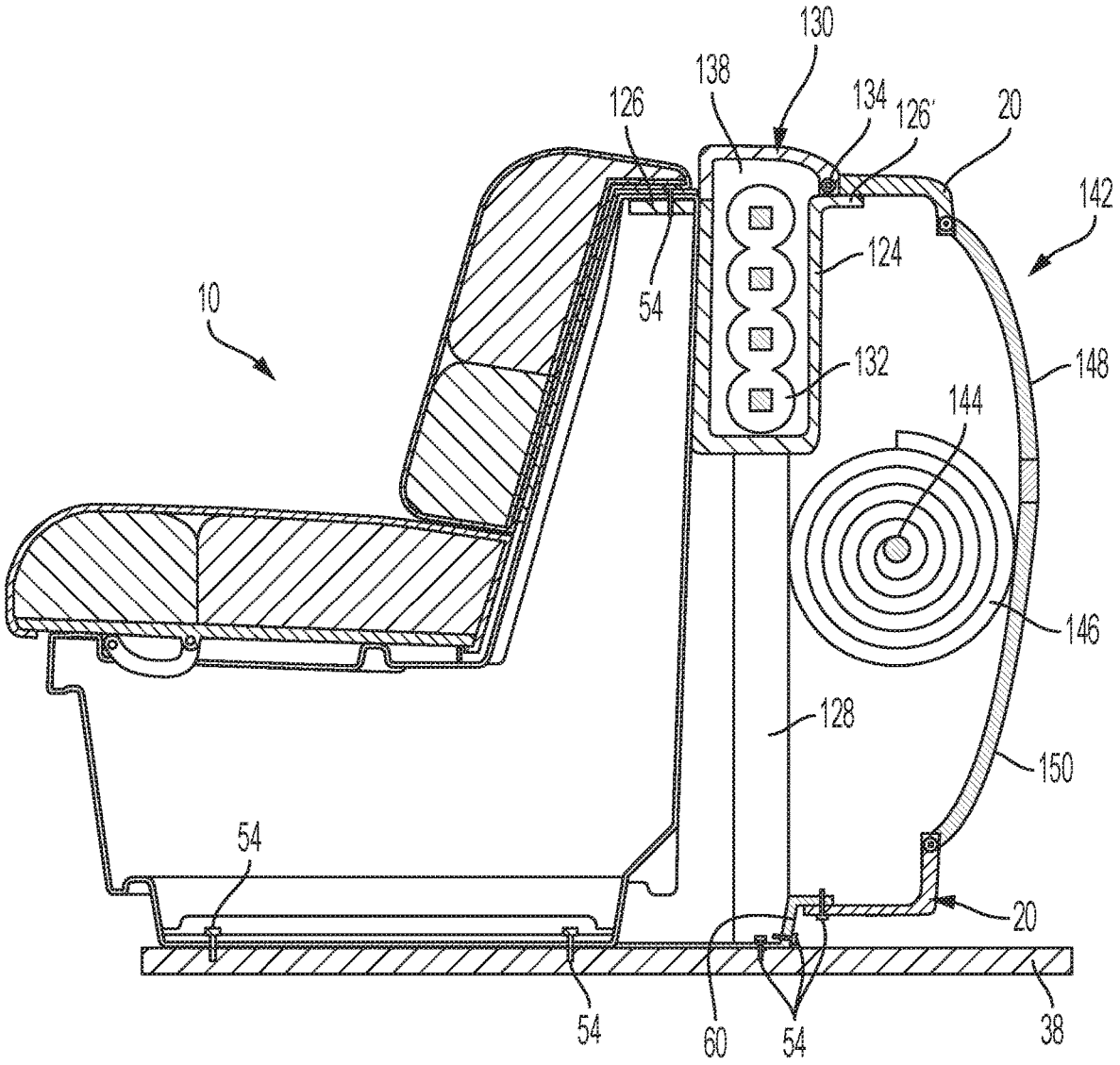
FIG. 19 is a cross-sectional elevation view of a seat embodiment with a cover assembly.

The seat enclosure 12 may also include a cover assembly 142 as seen in FIG. 19. In the embodiment seen in FIG. 19, the cover assembly 142 includes a rotatable member 144 positioned in the space between the base 22 and the panel 20. A material such as a cover 146 for the marine vehicle 18 could be wound and unwound around the rotatable member 144. The rotatable member 144 could have a means for winding the cover 146. For example, the rotatable member 144 could have a handle accessible from the cover assembly 142. Another example is that the rotatable member 144 could be connected to a motor. Yet another example is that the rotatable member 144 could be spring loaded, much like a hose real.

The cover assembly 142 can include at least one cover panel 148 to least partially enclose the cover assembly and help hide or make less noticeable the cover 146 when the cover is wound around the rotatable member 144. The cover panel 148 can be removed, folded or in the embodiment seen in FIG. 19, rotated up when it is desired to unwind the cover 146. The cover assembly 142 could also include a second cover panel 150 to provide access to additional storage space. This makes storing a cover 146 easier, potentially freeing up space on the deck 38 of the marine vehicle 18 for other uses. While FIG. 19 shows the cover assembly 142 in the center of the stern of the vehicle 18, the cover assembly could be off-center at the stern or on a side of the vehicle.

Figure 20:
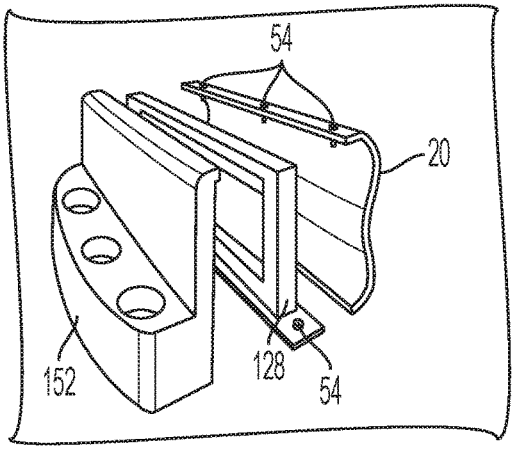
FIG. 20 is an exploded perspective view of inner panel.
Figure 21:
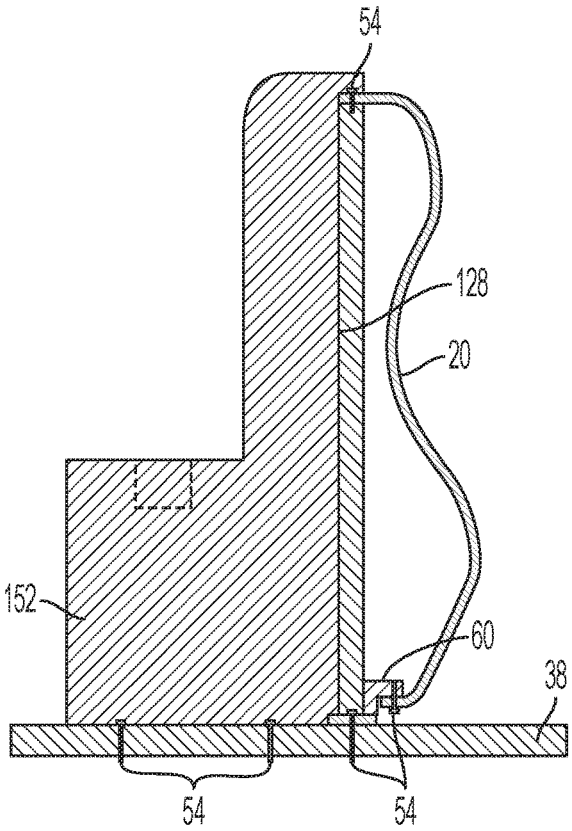
FIG. 21 is a cross-sectional elevation view of the inner panel embodiment FIG. 2 taken from the line 21-21.

In areas of the marine vehicle where seats are not desirable, the panel(s) 20 can be connected to inner panels 152, thereby forming the interior surface of the perimeter enclosure 12. The inner panels 152 can be formed to have additional contours and shapes such as cup holders, storage pockets, and other features as seen in FIGS. 20-21. The panel 20 as seen in the embodiment shown in FIG. 20 is attached at the top to a supporting member 128. A piece of angle iron 60 is attached to the bottom of the supporting member 128, such as by screws 54. The panel 20 is attached at its bottom to the angle iron 60 by screws 54. The top of the inner panels 152 covers the top of the panel 20 to hide the screws 54 and is glued to the top of the panel. The bottom of the inner panel(s) 152 could be attached to the deck 38 with screws, as described with respect to the base 22 described above. The inner panel could also be attached by other known methods, for example, an angle iron could be attached to the supporting member and the bottom of the inner panel 152 attached to the angle iron as described with respect to panel 20 above, the use of which would not defeat the spirit of the invention.

In one embodiment, the panel 20 and/or a panel portion 56, 58 is made from an acrylonitrile butadiene styrene material. Different color acrylonitrile butadiene styrene materials can be used for different panels and/or portions to offer more options for the vehicle's appearance. A clear acrylonitrile butadiene styrene material could also be used and a plastic material, e.g. acrylic film, attached to the exterior facing surface. The film could also be printed on to offer even more design options.

The panels 20 and/or a panel portion 56, 58 can also allow for new lighting options. The panels 20 and/or a panel portion 56, 58 made from a clear acrylonitrile butadiene styrene material can themselves or a portion 154 (as seen in FIG. 1) or portions thereof be left uncoated. Backlighting can be used, for example, a light that is between the base 22 and panels 20 and/or a panel portion 56, 58, such that light passes through the uncoated portion to show designs, shapes, logos, etc. Cutouts, inserts and/or undercuts, could also be used to permit lighting options and/or design features.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A seat structure for a pontoon boat having a deck; the seat structure comprising:

a base having, an interior cavity and an opening to the interior cavity formed in the base;

a back cushion attached to the base;

a seat cushion attached to the base and movable between a first position wherein the seat cushion covers the opening and can be used to sit on and a second position wherein the seat cushion generally does not cover the opening; and a panel attached to the base to form a back portion of the seat structure and configured to form a portion of an exterior perimeter of the deck when the seat structure s attached to the deck of the pontoon boat.

2. The seat structure of claim 1, wherein the panel further comprises a top panel portion and a bottom panel portion;

wherein the top panel portion is attached to the base at a first end of the top panel portion;

wherein the bottom panel portion is attached to the base at a first end of the bottom panel portion; and wherein a second end of the top panel portion is attached to a second end of the bottom panel portion.

3. The seat structure of claim 2, wherein the top panel portion has a first bend forming a first tab at the second end of the top panel portion;

wherein the bottom panel portion has a second bend forming a second tab art the second end of the bottom panel portion; and wherein the second end of the top panel portion is attached to a second end of the bottom panel portion by adhesive between the first tab and the second tab.

4. The seat structure of claim 3, wherein a slot is formed in the top panel portion;

wherein when the first tab is adhered to the second tab, an indentation is formed in the panel; and wherein the indentation provides access to the slot.

5. The seat structure of claim 1, wherein the panel further comprises a top panel portion and a bottom panel portion;

wherein the bottom panel portion has a hole formed therein and the bottom panel portion is attached to the base at a first end of the bottom panel portion and a second end of the bottom panel portion; and wherein the top panel portion is attached to the base at a first end and a second end of the top panel extends into the hole to attach the top panel portion to the bottom panel portion.

6. The seat structure of claim 1, further comprising:

an access door attached to thy: panel by a hinge;

wherein the base has a second opening formed in a backside of the base;

wherein the panel has an aperture formed therein; and wherein the access door is movable between a first position such that the access door covers the aperture and a second position wherein the access door generally does not cover the aperture to provide access to the interior cavity through the aperture and second opening.

7. The seat structure of claim 1, wherein the base has a ridge adjacent the opening;

wherein the seat cushion contacts the ridge when the seat cushion is in the first position; and wherein the seat cushion is pivotally attached to the base by a hinge that is attached at a first hinge end to a support of the seat cushion and a second hinge end to the ridge.

8. The seat structure of claim 7, wherein the base has a drainage tube to permit water to drain from a seating surface of the base; and wherein a bottom of the base has a passage to permit water to move from one side of the base to another side of the base.

9. The seat structure of claim 1; wherein the back cushion has a projection and the base has a slot formed therein and the back cushion is attached to the base by the projection being located in the slot.

10. The seat structure of claim 1, further comprising:

an access door attached to the panel and configured to move between a first position such that the access door covers an aperture formed in the panel and a second position wherein the access door generally does not cover the aperture and provides access to a space between the base and the panel; and a rotatable member positioned in the space and configured to wind and unwind a material.

11. The seat structure of claim 1 wherein, the panel is made from a vacuum formed plastic material.

12. The seat of claim 1 wherein; the base is made from a rotomolded plastic material.

13. The seat of claim 12 wherein; the plastic material is an acrylonitrile butadiene styrene material.

14. A seat for a marine vehicle having a bimini top, the seat comprising:

a base;

a back cushion attached to the base;

a seat cushion attached to the base;

a trough attached to the base, the trough forming an interior space;

a supporting member attached to the trough to support the trough;

a panel attached to the trough at a first end of the panel and to the supporting member at a second end of the panel;

a cover attached to the trough, the cover movable between a first position wherein the cover conceals the interior space and a second position wherein the cover generally does not conceal the interior space;

wherein the trough is configured such that when the bimini top is not in use; a portion of the bimini top is located in the interior space.

15. The seat of claim 14, wherein the trough is generally U-shaped and has a first flange and a second flange and wherein the trough attached to the base by the first flange and the first end of the panel is attached to the trough by the second flange.

16. The seat of claim 14, further comprising a secondary cover;

wherein the secondary cover is slidably connected to the cover;

wherein the secondary cover is configured to be slid between an extended position in which the secondary cover extends away from the cover and a contracted position in which the secondary cover is located below the cover;

wherein when the cover is moved between the first position and second position, the secondary cover is moved between the first position and second position.

17. The seat of claim 14, wherein a space is formed between the supporting member and the base and wherein the space is configured to selectively receive a pocket door.

18. An enclosure for a marine vehicle having a deck, the enclosure comprising:

a plurality of seats configured to be attached to the deck, each of the plurality of seats further comprising:

a base;

a back cushion attached to the base;

a seat cushion attached to the base; and a panel attached to the base such that it creates a backside of the base;

wherein when the plurality of seats are attached to the deck, the panels form at least a portion of an exterior perimeter of the marine vehicle around the deck; and wherein a first one of the plurality of seats has a first sidewall with a plurality of posts and a second one of the plurality of seats has a second sidewall with a plurality of holes formed therein and wherein the first one of the plurality of seats is attached to the second one of the plurality of seats when the plurality of posts are located in the plurality of holes.

19. The enclosure of claim 18 further comprising at least one gate;

wherein the at least one gate can be moved between a first position wherein ingress to the deck is permitted and a second position wherein ingress to the deck is not permitted; and wherein the at least one gate forms at least a portion of an exterior perimeter of the marine vehicle.

20. An enclosure for a marine vehicle having a deck, the enclosure comprising:

a plurality of seats configured to be attached to the deck, each of the plurality of seats further comprising:

a base;

a back cushion attached to the base, a seat cushion attached to the base; and a panel attached to the base such that it creates a backside of the base;

a stencil configured to be applied to the deck to identify a location of each of the plurality of seats;

wherein when the plurality of seats are attached to the deck, the panels form at least a portion of an exterior perimeter of the marine vehicle around the deck.

21. A seat for a marine vehicle having a deck, the seat comprising:

a frame configured to be connected to the deck;

a back rest connected to the frame;

a bottom rest connected to the frame;

a panel connected to the frame to create a backside of the seat and conceal a backside of the frame and configured to form a portion of an exterior body of the marine vehicle when the seat is attached to the deck.

22. The seat of claim 21, wherein the frame forms a hollow interior with an orifice for accessing the hollow interior;

wherein the bottom rest is attached to the frame by at least one hinge such that when the bottom rest is rotated away from the orifice, the hollow interior is accessible.

23. The seat of claim 22, wherein the bottom rest is configured to be rotated to a position in front of the frame.

24. The seat of claim 22, wherein the panel further comprises a first panel portion and a second panel portion;

wherein the first panel portion has a first panel first end and a first panel second end;

wherein the second panel portion has a second panel first end and a second panel second end;

wherein the first panel first end and second panel second end are connected to the frame; and wherein the first panel second end and second panel first end are connected to each other.

25. The seat of claim 24, wherein the first panel first end is connected to a top of the frame and wherein the back rest is connected to the frame such that a portion of the back rest is positioned on top of the first panel first end to conceal the first panel first end.

26. The seat of claim 24, wherein a bracket is connected to a backside of the frame adjacent a bottom portion of the frame and wherein the second panel second end is connected to the bracket.

27. The seat of claim 24, wherein the first panel second end is a first tab formed by a first bend in the first panel portion;

wherein the second panel first end is a second tab formed by a second bend in the second panel portion;

wherein the first tab and second tab are connected by adhesive; and wherein the first panel first end and second panel second end are connected to the frame by fasteners.

28. The seat of claim 21, wherein at least one receptacle is attached to the deck, the at least on receptacle configured to engage a puck attached to the frame when the seat is attached to the deck.

29. The seat of claim 21, further comprising a flap connected to the panel by a hinge and wherein the flap can be moved between a closed position such that the flap covers an opening in the panel and an open position wherein the flap generally does not cover the opening in the panel.

* * * * *